US011123893B2

(12) United States Patent
Schomber et al.

(10) Patent No.: US 11,123,893 B2
(45) Date of Patent: Sep. 21, 2021

(54) VACUUM ASSIST CUTTING AND ANVIL CYLINDERS

(71) Applicant: Roto-Die Company, Inc., Eureka, MO (US)

(72) Inventors: Charles E. Schomber, Catawissa, MO (US); Darrel D. Buchholz, Union, MO (US)

(73) Assignee: ROTO-DIE COMPANY, INC., Eureka, MO (US)

( * ) Notice: Subject to any disclaimer, the term of this patent is extended or adjusted under 35 U.S.C. 154(b) by 42 days.

(21) Appl. No.: 16/513,816

(22) Filed: Jul. 17, 2019

(65) Prior Publication Data

US 2020/0023539 A1 Jan. 23, 2020

Related U.S. Application Data

(60) Provisional application No. 62/699,952, filed on Jul. 18, 2018.

(51) Int. Cl.

| | |
|---|---|
| ***B26D 7/18*** | (2006.01) |
| ***B26F 1/44*** | (2006.01) |
| ***B26D 7/26*** | (2006.01) |
| ***B26F 1/38*** | (2006.01) |

(52) U.S. Cl.

CPC ..... *B26D 7/1863* (2013.01); *B26D 7/2614* (2013.01); *B26F 1/384* (2013.01); *B26F 1/44* (2013.01); *B26D 2007/2607* (2013.01)

(58) Field of Classification Search

CPC ..... B26D 7/1863; B26D 7/2614; B26F 1/44; B26F 1/384; B26F 1/10; B26F 1/08; B26F 1/14; B26F 1/02; B26F 1/38

USPC ..... 83/669, 670, 100

See application file for complete search history.

(56) References Cited

U.S. PATENT DOCUMENTS

| | | | | | |
|---|---|---|---|---|---|
| 2,141,492 | A | * | 12/1938 | Southwick | B26F 1/44 83/162 |
| 2,220,270 | A | * | 11/1940 | Page | B26F 1/08 225/2 |
| 3,063,319 | A | * | 11/1962 | Johnson | B26D 7/1818 83/126 |
| 3,166,965 | A | * | 1/1965 | Stemmler | B26D 7/2614 83/175 |
| 3,182,540 | A | | 5/1965 | Eichorn et al. | |

(Continued)

*Primary Examiner* — Kenneth E Peterson
*Assistant Examiner* — Nhat Chieu Q Do
(74) *Attorney, Agent, or Firm* — Thompson Coburn LLP

(57) ABSTRACT

A vacuum assist anvil cutting die set includes a cutting cylinder and an anvil cylinder. The cutting cylinder has an outer diameter surface with a cutting blade and a blade cavity adjacent to the cutting blade. The cutting cylinder has a vacuum port in communication with the blade cavity and is adapted and configured to be connected to a vacuum source to apply a vacuum to the blade cavity via the vacuum port. The anvil cylinder has an outer diameter surface with an anvil pin projecting from the outer diameter surface of the anvil cylinder. The anvil pin having a diameter and shape that closely approximates the blade cavity such that when a level of vacuum is applied to the cutting cylinder and the anvil cylinder is in rotational and linear register with the cutting cylinder, the anvil pin is insertable into the corresponding blade cavity in a manner to increase the level of vacuum of the blade cavity.

20 Claims, 4 Drawing Sheets

(56) References Cited

U.S. PATENT DOCUMENTS

| | | | | | |
|---|---|---|---|---|---|
| 3,194,095 | A * | 7/1965 | Buck | B26D 7/1863 | 83/100 |
| 3,209,630 | A | 10/1965 | McCartan | | |
| 3,222,968 | A * | 12/1965 | Larson | B21D 45/003 | 83/128 |
| 3,283,635 | A * | 11/1966 | Johnson | B26F 1/44 | 83/345 |
| 3,680,419 | A | 8/1972 | Stoop | | |
| 4,273,015 | A * | 6/1981 | Johnson | B26F 1/10 | 83/345 |
| 4,409,870 | A | 10/1983 | Rynik et al. | | |
| 4,599,926 | A | 7/1986 | Carlson, Jr. et al. | | |
| 5,449,482 | A * | 9/1995 | Faddar | B26D 7/1854 | 264/154 |
| 5,669,277 | A | 9/1997 | Perrone | | |
| 6,276,421 | B1 * | 8/2001 | Valenti | B26D 7/1863 | 156/256 |
| 6,725,751 | B1 * | 4/2004 | Surina | B21D 28/36 | 83/49 |
| 7,182,010 | B2 * | 2/2007 | Blank | B26F 1/384 | 83/338 |
| 2002/0088321 | A1 * | 7/2002 | Boscolo | B26F 1/08 | 83/30 |
| 2004/0216577 | A1 * | 11/2004 | McCrudden | B26F 1/14 | 83/684 |

* cited by examiner

VACUUM ASSIST CUTTING AND ANVIL CYLINDERS

RELATED APPLICATION DATA

This application claims the benefit of U.S. provisional application Ser. No. 62/699,952 flied on Jul. 18, 2018, the disclosure, of which is incorporated by reference herein.

SUMMARY

This disclosure is directed to vacuum cutting dies where a cutting surface formed on the cutting cylinder has a blade cavity in communication with a radial vacuum port and the anvil cylinder has an anvil pin that cooperates with the blade cavity to allow waste and trim from the cutting dies to be extracted to a main vacuum port in the center of the cutting cylinder, where the waste may then be taken away by vacuum to a waste collection unit.

DETAILED DESCRIPTION

Figure 1:
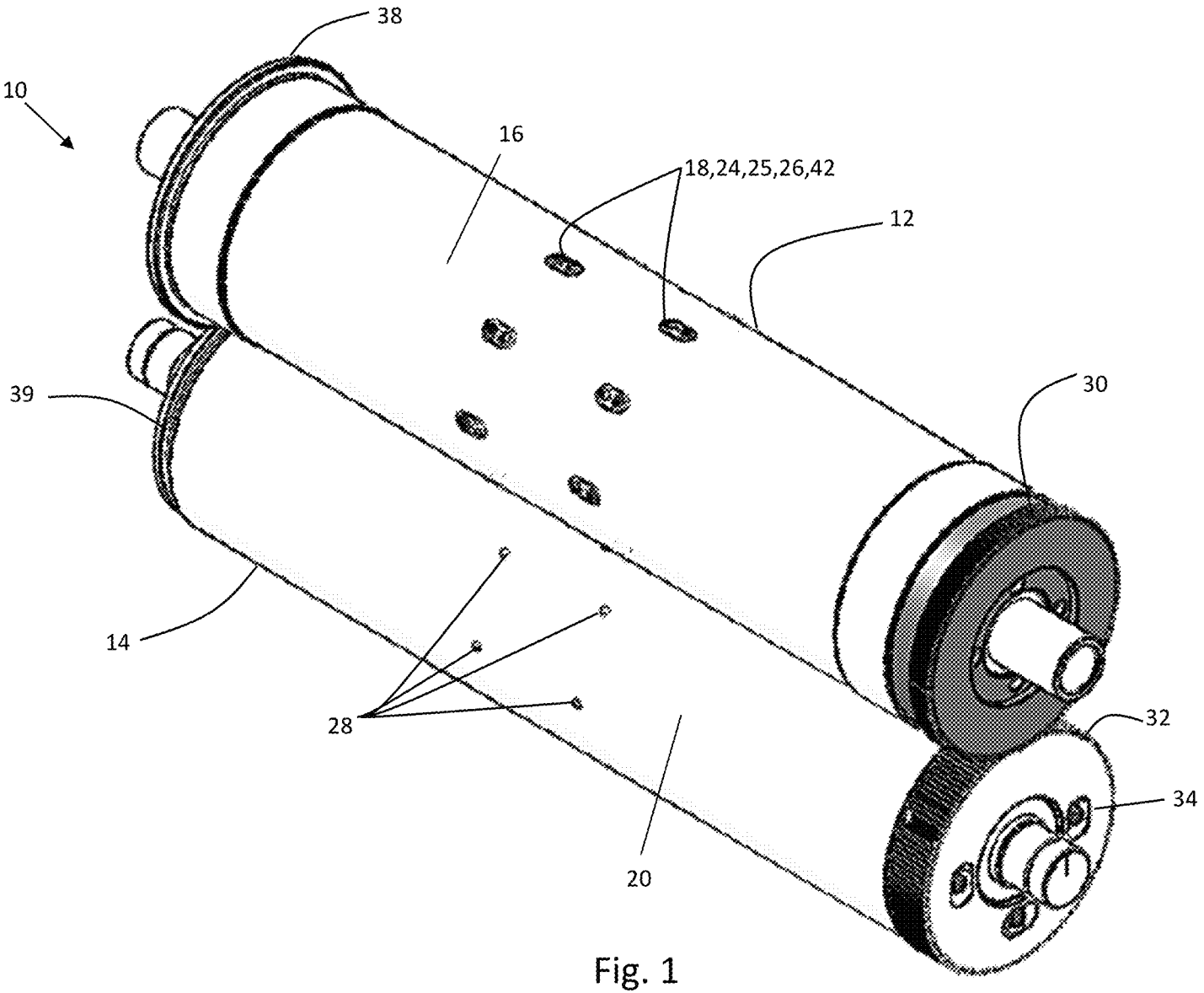
FIG. 1 is a perspective view of an exemplary cutting cylinder and anvil cylinder as described herein.

Referring to FIG. 1, which is a perspective view of an exemplary cutting cylinder and anvil cylinder of the present disclosure, there is a vacuum assist anvil cutting die set generally indicated by numeral 10. The vacuum assist anvil cutting die set 10 includes both a cutting cylinder 12 and an anvil cylinder 14. The cutting cylinder 12 has an outer diameter surface 16. The cutting cylinder 12 has a cutting surface 18 mounted to the outer diameter surface 16. The anvil cylinder 14 has an outer diameter surface 20. The web material to be processed is directed between the outer diameter surface 16 of the cutting cylinder 12 and the outer diameter surface of the anvil cylinder 14, and cut with the cutting surface 18.

Figure 4:
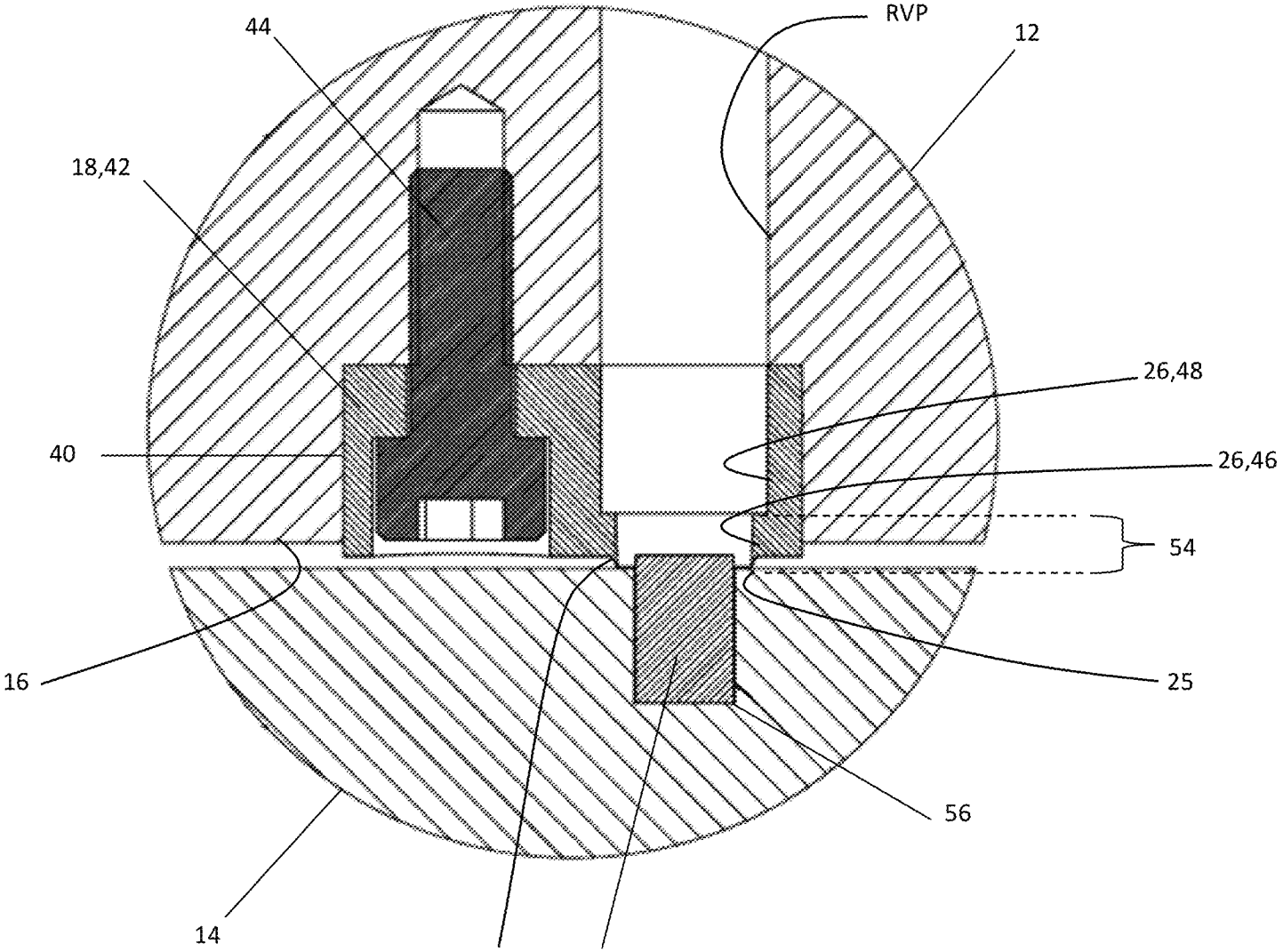
FIG. 4 is a partial enlarged cross section view from detail area 4-4 of FIG. 3.

As shown in FIG. 1, the cutting cylinder 12 may have more than one cutting surface 18. For instance, as shown in FIG. 4, the cutting surface 18 has a cutting blade 24 with a cutting edge 25 and a blade cavity 26 adjacent to the cutting blade. More in particular, and by way of example and not in any limiting sense, the cutting blade 24 may circumscribe the blade cavity 26. The cutting blade 24 may comprise an insert (FIG. 4, '42'), as described in greater detail below. Alternatively, the cutting cylinder may comprise a solid die such that the cutting blade may comprise a cutting surface formed on the outer diameter surface of the cutting cylinder by machining, grinding, EDM, etching, or another metal working process. Alternatively, the cutting cylinder may comprise a magnetic cylinder such that the cutting blade may comprise a flexible die mounted on the magnetic cylinder.

Referring again to FIG. 1, the outer diameter surface 20 of the anvil cylinder 14 has an anvil pin 28 projecting from the outer diameter surface 20. An anvil pin 28 may corresponds to a blade cavity 26 of the cutting cylinder 12. An anvil pin 28 may be in rotational and linear (i.e. axial) register with the corresponding cutting surface during rotational motion of the cutting cylinder 12 and the anvil cylinder 14. The number of anvil pins 28 may correspond to the number of blade cavities 26 on the cutting cylinder 12. As shown in FIG. 1, the anvil cylinder 14 has anvil pins 28 corresponding to each blade cavity on the cutting cylinder 12. The anvil pin 28 has a diameter and shape that closely approximates the corresponding blade cavity 26 on the cutting surface 18 of the cutting cylinder 12. An anvil pin 28 may be received in the blade cavity 26 to push a trim piece from the processed web into the blade cavity 26. The anvil pin 28 may have some clearance or interference with the blade cavity 26 to allow for the anvil pin to rotate into the blade cavity given the clearance between the anvil cylinder 14 and the cutting cylinder 12 and the thickness of the web material to be processed. Because the diameter and shape of the anvil pin 28 closely approximates the blade cavity 26, when a level of vacuum is applied to the cutting cylinder 12 and the anvil cylinder 14 is in rotational and linear registry with the cutting cylinder, the anvil pin is insertable into the corresponding blade cavity in a manner that increases the level of vacuum of the blade cavity.

Figure 2:
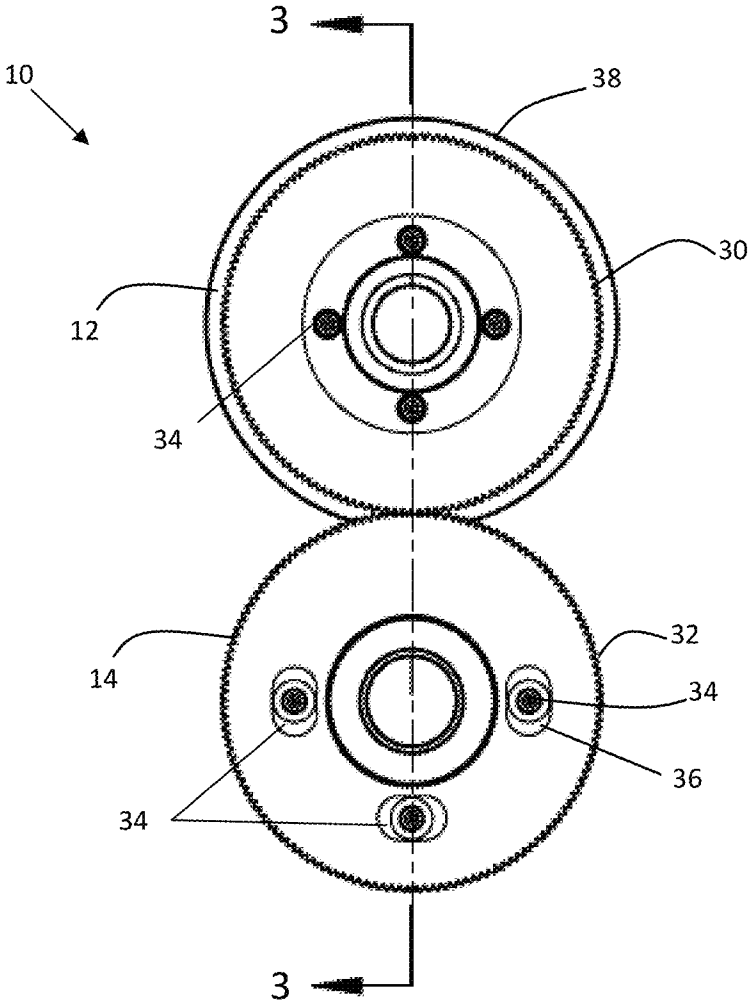
FIG. 2 is an end view of the cutting cylinder and anvil cylinder of FIG. 1 showing timing gears associated with the cutting cylinder and anvil cylinder.

FIGS. 1-2 further shows an embodiment of the vacuum assist anvil 10 wherein an axial end of the anvil cylinder 14 and a corresponding axial end of the cutting cylinder 12 may be engaged in a manner to maintain the anvil cylinder in rotation register with the cutting cylinder. FIGS. 1-2 display an embodiment wherein the axial end of the cutting cylinder 12 and the corresponding axial end of the anvil cylinder 14 have respective timing gears 30,32 to maintain the cylinders in proper rotational registry. As shown in FIG. 2, one or both of the timing gears 30,32 may be adjustably mounted to an axial face of the respective cylinder 12,14 using mechanical fasteners 34 that are directed through elongated slots 36 in the gear. Additionally, FIGS. 1-2 show an embodiment of the vacuum assist anvil cutting die set 10 wherein an axial end of the anvil cylinder 14 and a corresponding axial end of the cutting cylinder 12 may be engaged in a manner to maintain the anvil cylinder in linear register with the cutting cylinder. FIG. 1 displays an embodiment wherein the axial end of the cutting cylinder 12 and the corresponding axial end of the anvil cylinder 14 each have a respective registry ring 38,39. The provided registry rings 38,39 maintain the cutting cylinder 12 and anvil cylinder 14 in linear registry during rotational motion of the anvil cylinder and cutting cylinder. As shown in FIG. 1, ends of each of the cutting cylinder 12 and anvil cylinder 14 may be provided with the registry rings 38,39 and the opposite axial ends may be provided with the timing gears 30,32. The registry rings 38,39 may be adjustably mounted to the axial faces of the cutting cylinder 12 and/or the anvil cylinder 14, and/or may be formed or machined in one or more of the outer diameter surfaces of the respective cylinders 12,14.

Figure 3:
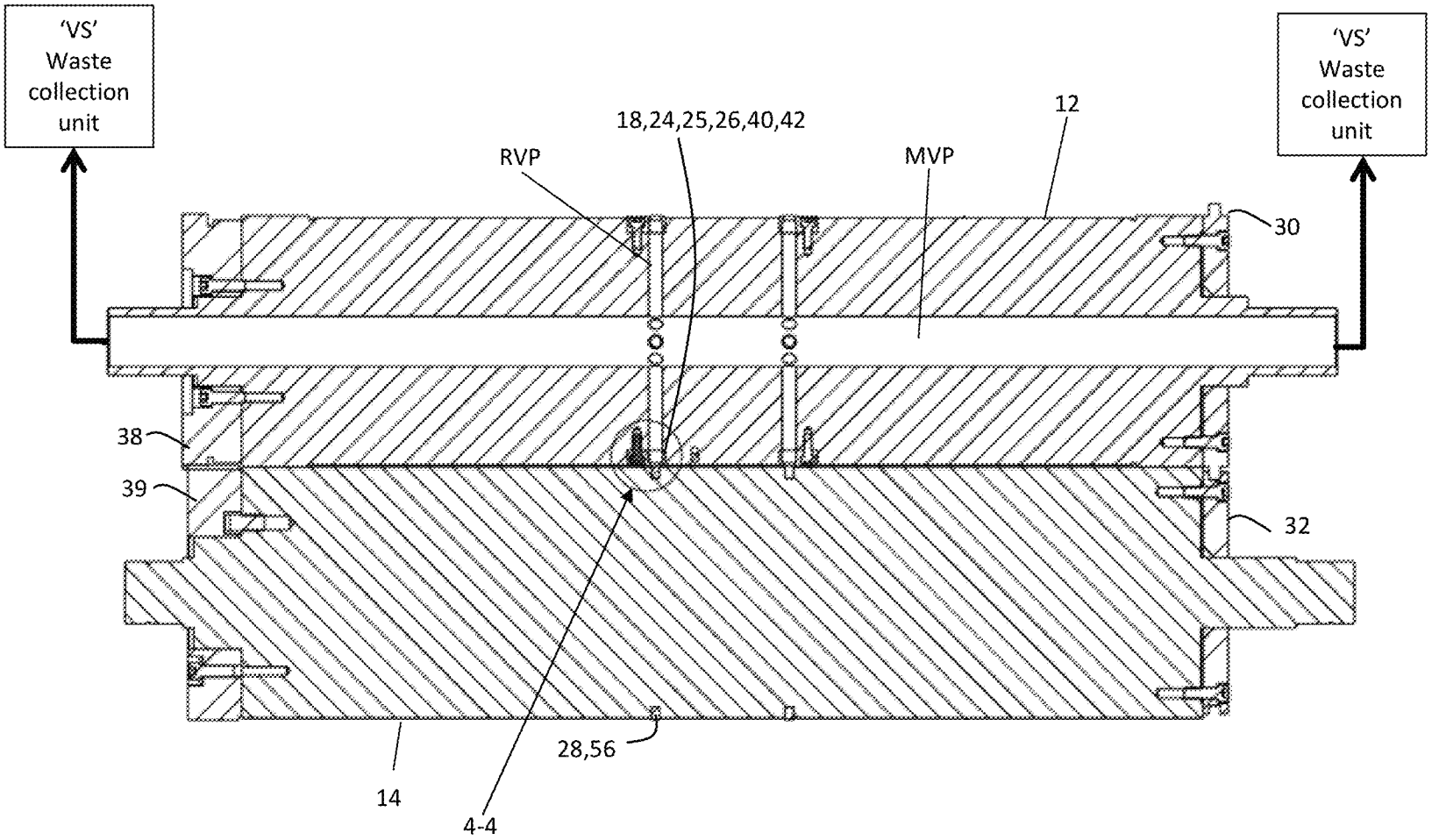
FIG. 3 is a cross section view of the cutting cylinder and anvil cylinder taken across lines 3-3 of FIG. 2.

A vacuum source VS and waste collection unit may be provided and aligned with the cutting cylinder 12 to draw away and remove trim and other waste material chads from the converting process. Referring to FIG. 3, the cutting cylinder 12 may have one or more vacuum ports MVP,RVP that provide communication between the blade cavity 26 and the vacuum source VS and waste collection unit. The cutting cylinder 12 may be connected to the vacuum source VS to apply a vacuum to the blade cavity 26 via the vacuum ports MVP,RVP. In one embodiment, the vacuum ports include a main vacuum port MVP that extends between axial ends of the cutting cylinder 12, and one or more radial vacuum port RVP that extend radially from the main vacuum port MVP to the blade cavity 26.

The cutting pattern on the cutting cylinder may be defined by one or more cutting surfaces 18 or cutting blades 24 of the rotary cutting cylinder 12 and one or more blade cavities 26 may be associated with the cutting blades. One or more blade cavities 26 may be aligned with the radial vacuum ports RVP so the radial vacuum port in effect extends from the main vacuum port MVP in the center of the cutting cylinder 12 to the outer diameter surface 16 of the cutting cylinder. The main vacuum port MVP may be generally coaxially aligned with the spindle or journal of the cutting cylinder 12. The main vacuum port MVP may extend through the axial ends of the cutting cylinder 12 through conduits passing through the drive and bearers of the cutting cylinder to the vacuum source VS and the waste collection unit. The main vacuum port MVP and the radial vacuum ports RVP may communicate with one or more blade cavities 26 so trim or chads cut by the surfaces of the blade may pass into the opening under vacuum pressure and be extracted from the cutting die set 10.

Referring again to FIGS. 3-4, in one embodiment, the outer diameter surface 16 of the cutting cylinder 12 has an insert recess 40 adapted and configured to receive a blade insert 42. In this embodiment, the cutting surface 18 comprises the blade insert 42, and the blade insert comprises the cutting blade 24 with the cutting edge 25, and the blade cavity 26 is formed in the blade insert. The blade insert 42 may be secured to the cutting cylinder 12 with a mechanical fastener 44. As shown in FIG. 4, the cutting cylinder 12 may have radial vacuum ports RVP extending from the center main vacuum port MVP to the insert recess 40, and into the blade cavity 26 formed in the blade insert 42 when the insert is inserted in the recess.

Referring to FIG. 4, in one embodiment, the blade cavity 26 formed in the blade insert 42 comprises a first portion 46 and a second portion 48. The first portion 46 is adjacent to the outer diameter surface 16 of the cutting cylinder 12 when the blade insert 42 is inserted in the insert recess 40 and the second portion 48 is adjacent to and aligned with the radial vacuum port RVP. The first portion 46 is configured to receive the anvil pin 28 insertable into the blade cavity 26. The first portion 46 may have a radial cross-section to receive the anvil pin with some clearance or interference to allow for the anvil pin to rotate into the blade cavity given the clearance between the anvil cylinder 14 and the cutting cylinder 12 and the thickness of the web material to be processed. The second portion 48 of the blade cavity 26 may have a radial cross-section larger than the first portion 46 radial cross section. In this way, the blade cavity 26 may have a second portion 48 that may be enlarged relative to the first portion 46. The enlarged portion is dimensioned to allow a smooth transition for the trim piece as it is drawn from the first portion 46 to the second portion 48 and into the radial vacuum port RVP.

The blade cavity 26 (whether in the blade insert 42, formed on a flexible die, or the cutting surface 18 of a solid die) may have a shape and dimension that corresponds to a hole to be cut in a web material. The first portion 46 of the blade cavity 26 may be sized and dimensioned to cut the web material at a desired dimension. The radial depth 54 of the first portion 46 of the blade cavity 26 may be sized to accommodate the thickness of the material to be cut and to allow one or more resultant cut trim pieces to be received or drawn into the first portion via vacuum force. The depth 54 of the first portion 46 may be dimensioned to accommodate multiple pieces of trim material received during processing.

In one embodiment of a vacuum assist anvil die set 10, the anvil cylinder 14 has a radial hole 56 on the outer diameter surface 20 of the anvil cylinder 14. As shown in FIG. 4, in this embodiment, the anvil pin 28 is inserted in the radial hole 56 and projects from the radial hole. In this embodiment, the anvil cylinder 14 may have one or more anvil pins 28 secured in radial holes 56 extending around the outer diameter surface 20 of the anvil cylinder. The anvil pins 28 may be nylon pins and may be press fit and adhered into the radial holes 56 of the anvil cylinder 14.

The exposed length and diameter of the anvil pin 28 may be sized as needed depending upon the converting process, web thickness, and blade cavity. The anvil pin 28 may have a diameter and shape which closely approximates the size and shape of the first portion 46 of the opening, and thus, the anvil pin assists in forming a seal in the blade cavity and/or forces the cut trim piece into the first portion 46 of the blade cavity 26, which in turn allows the vacuum applied to the radial vacuum port RVP to draw the trim piece from the first portion of the opening to the second portion 48 of the opening. The vacuum source VS may then draw the trim piece into the radial vacuum port RVP and main vacuum port to the waste collection unit.

As described above, the anvil pin 28 of the anvil cylinder 14 assists in the vacuuming of small substrate slugs or trim pieces into the cutting die for removal from the web/part during processing. Materials or cut cavity shapes, which are otherwise difficult to remove because they fail to form a vacuum seal at the cutting tip of the blade insert 42, are pushed into the opening around the cutting surfaces of the blade insert via the anvil pin 28. The anvil pin 28 cooperates with the blade cavity 26 adjacent to the cutting surface 18 to push the slug or trim piece into opening and to assist in forming a seal that facilitates removing the slug or trim piece. The anvil and cutting cylinder timing gears 30,32 and registry rings 38,39 maintain registry of the anvil pin 28 with the cutting die to align the pin/vacuum blade insert opening accurately. The use of the vacuum assist anvil cutting die set 10 enables users to run thinner, porous, and more challenging materials successfully and all materials to run faster with a higher level of slug or trim collection.

The embodiments were chosen and described in order to best explain the principles of the disclosure and their practical application to thereby enable others skilled in the art to best utilize the disclosed embodiments and with various modifications as are suited to the particular use contemplated. As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A vacuum assist anvil cutting die set comprising:

a cutting cylinder, the cutting cylinder having an outer diameter surface, the outer diameter surface of the cutting cylinder having a cutting blade with a cutting edge and a blade cavity adjacent to the cutting edge of the cutting blade, the cutting cylinder having a vacuum port, the vacuum port being in communication with the blade cavity, the cutting cylinder being adapted and configured to be connected to a vacuum source to apply a vacuum to the blade cavity via the vacuum port; and an anvil cylinder, the anvil cylinder having an outer diameter surface, the anvil cylinder having an anvil pin projecting from the outer diameter surface of the anvil cylinder and stationary in a radial direction, the anvil pin having a diameter and shape that is between the blade cavity such that when a level of vacuum is applied to the cutting cylinder and the anvil cylinder is in rotational and axial register with the cutting cylinder, the anvil pin is insertable into the corresponding blade cavity in a manner to increase the level of vacuum of the blade cavity, the outer cylindrical surface of the anvil cylinder and the cutting edge of the cutting blade of the cutting cylinder being adapted and configured to cut a web passing between the anvil cylinder and the cutting cylinder independent of the anvil pin, the anvil pin being spaced from the cutting edge of the cutting blade and devoid of contact with the cutting edge of the cutting blade so that the cutting edge of the cutting blade of the cutting cylinder acting on the outer cylindrical surface of the anvil cylinder cut the web passing between the anvil cylinder and the cutting cylinder and form a slug cut from the web, and the anvil pin pushes the slug into the blade cavity.

2. The vacuum assist anvil cutting die set of claim 1 wherein the vacuum port comprises a main vacuum port extending between axial ends of the cutting cylinder and a radial vacuum port extending from the main vacuum port to the blade cavity.

3. The vacuum assist anvil cutting die set of claim 1 wherein the outer diameter surface of the cutting cylinder has an insert recess adapted and configured to receive a blade insert, the blade insert comprising the cutting blade.

4. The vacuum assist anvil cutting die set of claim 3 wherein the blade insert is adapted and configured to be secured to the cutting cylinder with a mechanical fastener.

5. The vacuum assist anvil cutting die set of claim 1 wherein the blade cavity comprises a first portion and a second portion, the first portion being adjacent the outer diameter surface of the cutting cylinder, the first portion being configured to receive the anvil pin insertable into the blade cavity, the first portion having a radial cross-section and the second portion having a radial cross-section larger than the first portion radial cross-section.

6. The vacuum assist anvil cutting die set of claim 1 wherein an axial end of the anvil cylinder and a corresponding axial end of the cutting cylinder are adapted and configured to engage a manner to maintain the anvil cylinder in rotational register with the cutting cylinder.

7. The vacuum assist anvil cutting die set of claim 6 wherein the axial end of the anvil cylinder and the corresponding axial end of the cutting cylinder each have a intermeshing timing gear.

8. The vacuum assist anvil cutting die set of claim 1 wherein an axial end of the anvil cylinder and a corresponding axial end of the cutting cylinder are adapted and configured to engage in a manner to maintain the anvil cylinder in axial register with the cutting cylinder.

9. The vacuum assist anvil cutting die set of claim 8 wherein the axial end of the anvil cylinder and the corresponding axial end of the cutting cylinder each have an engaging registry ring.

10. The vacuum assist anvil cutting die set of claim 1 wherein the anvil cylinder has a bore on the outer diameter surface of the anvil cylinder, the anvil pin is inserted in the bore and projects from the bore.

11. A vacuum assist anvil cutting die set comprising:

a cutting cylinder, the cutting cylinder having an outer diameter surface, the cutting cylinder having a cutting surface mounted to the outer diameter surface of the cutting cylinder, the cutting surface having a cutting blade with a cutting edge and a blade cavity adjacent to the cutting edge of the cutting blade, the cutting cylinder having a vacuum port, the vacuum port being in communication with the blade cavity, the cutting cylinder being adapted and configured to be connected to a vacuum source to apply a vacuum to the blade cavity via the vacuum port; and an anvil cylinder, the anvil cylinder having an outer diameter surface, the anvil cylinder having an anvil pin projecting from the outer diameter surface of the anvil cylinder and stationary in a radial direction, the anvil pin having a diameter and shape that is adjacent to the blade cavity such that when a level of vacuum is applied to the cutting cylinder and the anvil cylinder is in rotational and axial register with the cutting cylinder, the anvil pin is insertable into the corresponding blade cavity in a manner to increase the level of vacuum of the blade cavity, the outer cylindrical surface of the anvil cylinder and the cutting edge of the cutting blade of the cutting cylinder being adapted and configured to cut a web passing between the anvil cylinder and the cutting cylinder independent of the anvil pin, the anvil pin being spaced from the cutting edge of the cutting blade and devoid of contact with the cutting edge of the cutting blade so that the cutting edge of the cutting blade of the cutting cylinder acting on the outer cylindrical surface of the anvil cylinder cut the web passing between the anvil cylinder and the cutting cylinder and form a slug cut from the web, and the anvil pin pushes the slug into the blade cavity.

12. The vacuum assist anvil cutting die set of claim 11 wherein the vacuum port comprises a main vacuum port extending between axial ends of the cutting cylinder and a radial vacuum port extending from the main vacuum port to the blade cavity.

13. The vacuum assist anvil cutting die set of claim 11 wherein the outer diameter surface of the cutting cylinder has an insert recess adapted and configured to receive a blade insert, the cutting surface comprises the blade insert mounted to the outer diameter surface of the cutting cylinder, the blade insert comprises the cutting blade with cutting edge.

14. The vacuum assist anvil cutting die set of claim 13 wherein the blade insert is adapted and configured to be secured to the cutting cylinder with a mechanical fastener.

15. The vacuum assist anvil cutting die set of claim 11 wherein the blade cavity comprises a first portion and a second portion, the first portion being adjacent the outer diameter surface of the cutting cylinder, the first portion being configured to receive the anvil pin insertable into the blade cavity, the first portion having a radial cross-section and the second portion having a radial cross-section larger than the first portion radial cross-section.

16. The vacuum assist anvil cutting die set of claim 11 wherein an axial end of the anvil cylinder and a corresponding axial end of the cutting cylinder are adapted and configured to engage a manner to maintain the anvil cylinder in rotational register with the cutting cylinder.

17. The vacuum assist anvil cutting die set of claim 16 wherein the axial end of the anvil cylinder and the corresponding axial end of the cutting cylinder each have a intermeshing timing gear.

18. The vacuum assist anvil cutting die set of claim 11 wherein an axial end of the anvil cylinder and a corresponding axial end of the cutting cylinder are adapted and configured to engage in a manner to maintain the anvil cylinder in axial register with the cutting cylinder.

19. The vacuum assist anvil cutting die set of claim 18 wherein the axial end of the anvil cylinder and the corresponding axial end of the cutting cylinder each have an engaging registry ring.

20. The vacuum assist anvil cutting die set of claim 11 wherein the anvil cylinder has a bore on the outer diameter surface of the anvil cylinder, the anvil pin is inserted in the bore and projects from the bore.

* * * * *